United States Patent [19]

Schlueter et al.

[11] Patent Number: 4,751,038

[45] Date of Patent: Jun. 14, 1988

[54] MANUFACTURING METHOD FOR PRODUCING GOLD-CROWNED DOMED GARMENT BUTTON

[75] Inventors: Gary R. Schlueter, Castro Valley; Karsten K. Kettlitz, San Leandro, both of Calif.; Louis F. Arnone, III, 9 Pleasant View Rd., Novato, Calif. 94947

[73] Assignee: Louis F. Arnone, III, Concord, Calif.

[21] Appl. No.: 57,379

[22] Filed: Jun. 2, 1987

Related U.S. Application Data

[62] Division of Ser. No. 714,715, Mar. 21, 1985, Pat. No. 4,672,718.

[51] Int. Cl.[4] ..... B29C 45/36; B29C 39/12; B32B 31/06

[52] U.S. Cl. ..... 264/511; 264/247; 264/262; 264/263; 264/DIG. 34

[58] Field of Search ..... 264/DIG. 34, 511, 262, 264/247, 263; 425/DIG. 801

[56] References Cited

U.S. PATENT DOCUMENTS

| | | | |
|---|---|---|---|
| 748,411 | 12/1903 | Neuberth | 24/101 R |
| 956,485 | 4/1910 | Conklin | 264/274 X |
| 3,247,550 | 4/1966 | Haines, Jr. | 264/511 X |

FOREIGN PATENT DOCUMENTS

| | | | |
|---|---|---|---|
| 61-173913 | 8/1986 | Japan | 264/511 |

*Primary Examiner*—Jan H. Silbaugh
*Assistant Examiner*—Yun H. Wang
*Attorney, Agent, or Firm*—Limbach, Limbach & Sutton

[57] ABSTRACT

A crowned, domed garment button for use with a garment. The garment button comprises a generally cylindrical base member, a generally disc-like front facing portion, the facing portion, configured in a generally domed convex configuration, includes a periphery, and a generally annular rim portion, the rim portion being adapted to embed the front facing portion periphery, whereby the rim portion accentuates the domed front facing portion.

13 Claims, 2 Drawing Sheets

MANUFACTURING METHOD FOR PRODUCING GOLD-CROWNED DOMED GARMENT BUTTON

This is a division of application Ser. No. 714,715, filed Mar. 21, 1985 now U.S. Pat. No. 4,672,718.

TECHNICAL FIELD

This invention relates to garment buttons, and more particularly, to gold-crowned, domed garment buttons.

BACKGROUND ART

Garment buttons are common in the art. They are generally manufactured from a thermoplastic material. In addition, they are generally manufactured with an assortment of colors such that buttons having a particular color may be matched with the color of the garment. In general, the design of the buttons, in conjunction with the selected color, cause the buttons to be rather unobtrusive. Thus, buttons on a piece of garment generally do not stand out, accomplishing the designer's goal of having the garment as the primary attraction.

In one type of garment, however, buttons are being used for more than their utilitarian functions. Buttons which are used on denim-type clothing are being used, inter alia, for trademark purposes. These buttons are generally manufactured from a metallic material such as bronze or other alloys so as to stand out. These metallic buttons are designed to project a rugged and sturdy impression for the garment. Logos, designs and symbols may also be embossed on these buttons. Due to the recent popularity of these rugged, work clothing among the urbane and the sophisticated, clothing in this general motif require buttons which are appropriate to the genre. Clothing of this type, generally referred to in the vernacular as designer jeans, must evoke sufficient sophistication and opulence such that they are attracted to and attractive on those who are members of the young upwardly-mobile segment of the population. To that end, gold or gold-crowned buttons are needed. Since gold is a precious commodity, gold crowning is the only viable alternative. Such gold-crowned buttons must still project the sophisticated and opulent look.

DISCLOSURE OF THE INVENTION

It is a major object of the present invention to provide a garment button that projects a sophisticated and opulent look.

It is another object of the present invention to provide a method of manufacturing such garment buttons such that their sophisticated and opulent look is maximized.

It is a further object of the present invention to provide a garment button and a manufacturing method of such garment buttons in which the quantity of the necessary precious metal is minimized.

In order to accomplish the above and still further objects, the present invention provides a crowned, domed garment button for use with a garment. The garment button comprises a generally cylindrical base member, a generally disc-like front facing portion, the facing portion, configured in a generally domed convex configuration, includes a periphery, and a generally annular rim portion, the rim portion being adapted to embed the front facing portion periphery, whereby the rim portion accentuates the domed front facing portion.

Other objects, features, and advantages of the present invention will appear from the following detailed description of the best mode of a preferred embodiment, taken together with the accompanying drawings.

BEST MODE FOR CARRYING OUT THE INVENTION

Figure 1:
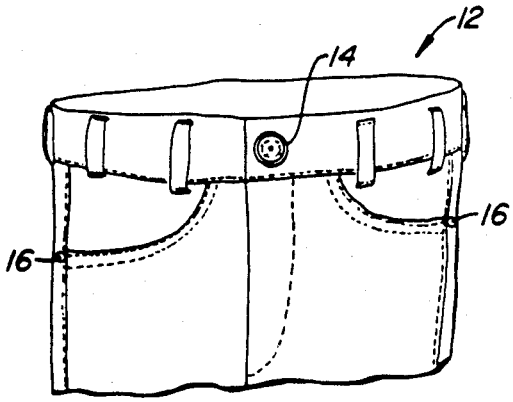
FIG. 1 is a perspective view of the garment buttons of the present invention, as attached to a garment, partially broken away.
Figure 2:
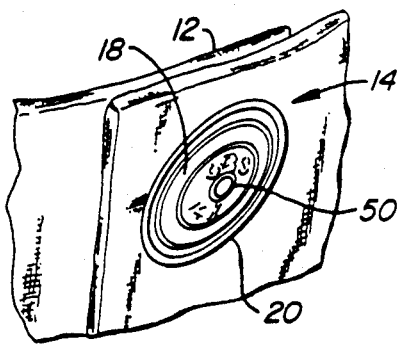
FIG. 2 is an enlarged perspective view of one embodiment of the garment buttons of FIG. 1.

Referring to FIG. 1, there is shown a garment, generally designated 12. Garment 12 includes at least one button 14 that is positioned at the waist portion of garment 12, and a plurality of smaller buttons 16 which are positioned at other locations of garment 12. Smaller buttons 16 are generally referred to as rivets. As best shown in FIG. 2, button 14 comprises a central metallic facing portion 18 and an annular rim 20. Central facing portion 18 may include logos, designs and symbols which are merely decorative and/or functioning as trademarks. Annular rim 20 is generally manufactured from a material different from the material of central facing portion 18 such that rim 20 accentuates central facing portion 18. Accordingly, if central facing portion 18 is manufactured with a bright and shining color such as gold, rim 20 is manufactured with a black-colored thermoplastic material in order to accentuate the golden color of central portion 18.

Figure 3:
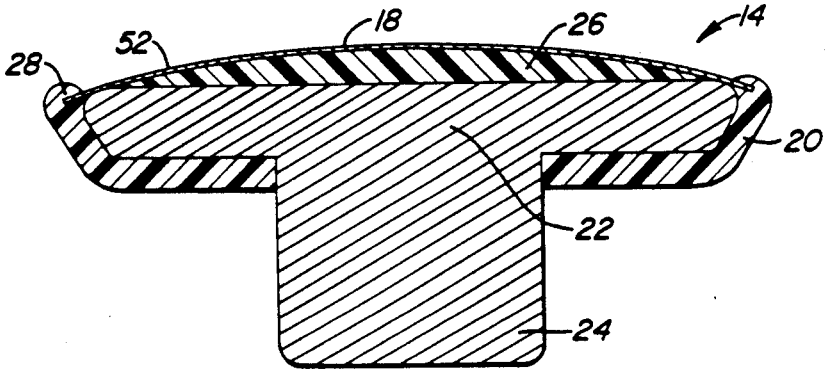
FIG. 3 is an enlarged cross section view of the garment button of FIG. 2.

More particularly, as best shown in FIG. 3, button 14 comprises a generally cylindrical base member 22, an attachment member 24, a domed, disc-like central facing portion 18, and an annular rim 20. To maintain central facing portion 18 in its domed configuration, a backing member 26 is positioned between facing portion 18 and base member 22. In addition, facing portion 18 comprises a generally circular periphery 28 and a central indentation 50. The outer domed surface of facing portion is designated as the convex surface 52. Button 14 is manufactured in such a fashion that periphery 28 of facing portion 18 is embedded within annular rim 20. In the preferred embodiment, base member 22 and attachment member 24 are manufactured from a metallic material such as copper-plated or cadmium-plated steel. Attachment member 24 is adapted to attach button 14 onto garment 12. In addition, facing portion 18 is manufactured from a precious metal such as gold, whereby its lustre will be attractive and stand out in relation to the material of garment 12. The placement of an attractive precious metal, in the form of facing portion 18, onto a base member manufactured from a conventional material contributes to the characterization of "crowned." Further, annular rim 20 and domed backing member 26 are manufactured from a thermoplastic material. The overall diameter of button 14 in the preferred embodiment is approximately 0.730 inch. The diameter of facing portion 18, from periphery 28 to periphery 28, is approximately 0.690 inch, with the exposed portion of facing portion 18 having a diameter of approximately 0.646 inch. Central indentation 50 has a diameter of approximately 0.120 inch.

Figure 4:
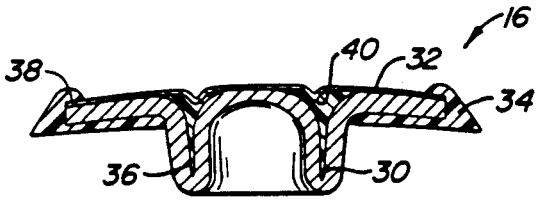
FIG. 4 is an enlarged cross section view of another embodiment of the garment buttons of FIG. 1.

For alternative rivets or buttons 16, as best shown in FIG. 4, it comprises a base member 30, a central facing portion 32, and an annular rim 34. Base member 30, manufactured from a metallic material in the preferred embodiment, is adapted to both support facing portion 32 and be used to attach rivet 16 onto garment 12. In this embodiment, base member 30 has a generally domed configuration for supporting facing portion 32. In addition, base member 30 includes a generally circular groove 36 in which material may be positioned to maintain facing portion 32 in its domed configuration. Moreover, facing portion 32 comprises a generally circular periphery 38 that is embedded within annular rim 34. In the preferred embodiment, base member 30 is manufactured from a metallic material such as copper-plated or cadmium-plated steel. Front facing portion 32 is manufactured from a precious metal such as gold. Rim 34 and the material placed in groove 36 are thermoplastic material. Facing portion 32 also includes a circular indentation 40. In the preferred embodiment, rivet 16 has a diameter of approximately 0.430 inch. The overall diameter of facing portion 32, from periphery 38 to periphery 38, is approximately 0.375 inch, with the exposed area of facing portion 32 having a diameter of approximately 0.350 inch. The diameter of indentation 40 is approximately 0.120 inch.

Figure 5:
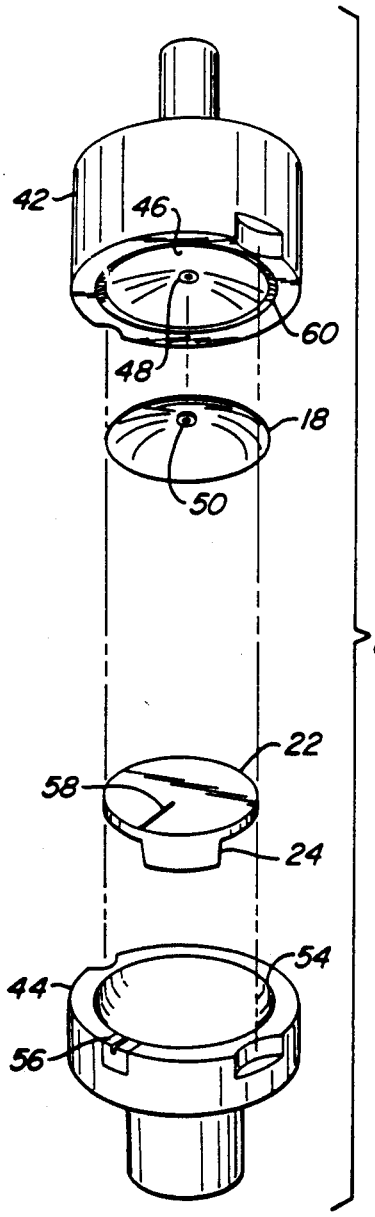
FIG. 5 is a perspective, exploded view of a manufacturing method of such garment buttons of the present invention.

As best shown in FIG. 5, a method of manufacturing buttons 14 and rivets 16 is illustrated. For the purposes of illustration, only the elements for button 14 are described. Rivets 16 are manufactured in a comparable fashion. Central facing portion 18 is first provided. Facing portion 18 is already stamped out in its generally disc-like configuration from a strip of gold. The strip of gold, not shown, has a thickness of approximately 0.003 inch. The strip of gold is generally annealed to an appropriate softness and polished to an appropriate lustre. These steps are accomplished by conventional methods. Moreover, facing portion 18 at this stage has already been embossed with a logo, a design or a symbol, as best shown in FIG. 2. Next, a pair of complimentary dies 42 and 44 are provided. Upper die 42 includes a generally circular, depressed working portion 46 which is adapted to receive facing portion 18. Upper die working portion 46 includes a central orifice 48 that is connected to an internal tube, not shown. Orifice 48 is also adapted for aligning facing portion 18. The central indentation 50 of facing portion 18 is aligned with orifice 48. The depressed upper die working portion 48 is adapted to receive convex surface 52 of facing portion 18, as best shown in FIG. 5. Further, upper die 42 includes a generally circular groove 60 that is positioned around the periphery of working portion 46. Groove 60 is adapted to form annular rim 20 of button 14.

Lower die 44 includes a generally hollow, interior chamber 54 that is adapted to receive base member 22 and attachment member 24. In essence, base member 22 and attachment member 24 are parts of an existing, conventional button. Thus, working portion 54 of lower die 44 is adapted to receive the entire existing button. Lower die 44 includes an injection orifice 56. In addition, base member 22 includes a radially extending groove 58 on its upper surface. Groove 58 is adapted to be axially aligned with injection orifice 56 when base member 22 is received within lower die working chamber 54.

In operation, an existing button having base member 22 and attachment member 24 is positioned within lower die working chamber 54. Base member 22 is positioned in such a fashion that its groove 58 is aligned with injection orifice 56. Simultaneously, a facing portion 18 is positioned within upper die working portion 46. Facing portion 18 is received within working portion 46 in such a fashion that its upper convex surface 52 is in contact with working portion 46. In addition, orifice 48 is aligned with indentation 50 of facing portion 18. Further, due to the evacuation of the internal pipe of upper die 42, creating a vacuum, front facing portion 18 is suctionally attached to upper die 42. When upper die 42 and lower die 44 are mated, a thermoplastic material is injected through injection orifice 56, using a method generally referred to as injection molding. Some of the thermoplastic material is injected through groove 58 and positioned underneath front facing portion 18 such that when hardens it forms dome backing member 26. Simultaneously, some of the thermoplastic material form annular rim 20. Annular rim 20 is formed by annular groove 60.

Figure 6:
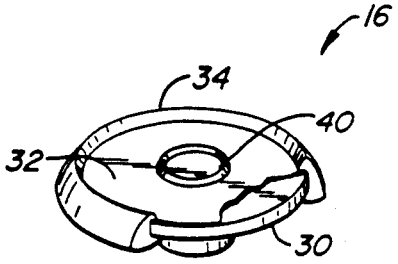
FIG. 6 is an enlarged, perspective view of the garment button of the another embodiment of FIGS. 1 and 4, partially broken away.

In FIG. 6, there is illustrated a perspective, partially broken away view of rivet 16.

Figure 7:
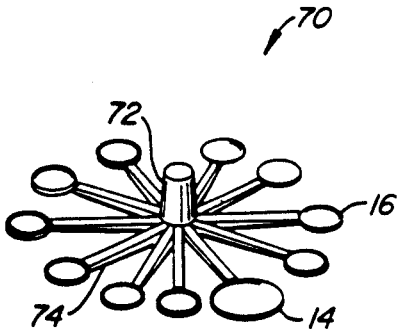
FIG. 7 is a perspective view of a button carrier of the present invention.

In an alternative embodiment to the manufacturing method, an inventory technique utilizing a button carrier 70 is illustrated in FIG. 7. In this technique, a plurality of upper and lower dies 42 and 44 are positioned in a generally circular fashion, not shown. An injection molding source, also not shown, is positioned in a central location. Due to the simultaneous injection of thermoplastic material into the plurality of dies 42 and 44, the resultant, hardened thermoplastic material is button carrier 70. Button carrier 70 is in essence the sprue of the injection molding process. Button carrier 70 includes a hardened, central post 72 having at one end a plurality of spoke-like extensions 74. Attached to the outer end of each spoke 74 is either a button 14 or a rivet 16. Each spoke 74 is attached to either outer rim 20 of button 14 or outer rim 34 of rivet 16. Each button or rivet is connected to spoke 74 by the thermoplastic material that has hardened within each injection orifice 56 of lower die 44. Since the amount of thermoplastic material that has hardened in injection orifice 56 is very small, forming a relatively thin bridge between the button and spoke 74, that button can be readily snapped off extension 74.

In light of the fact that each button or rivet includes a precious metal front facing portion, carrier 70 also functions as an inventory device. To prevent theft or misplacement of these relatively expensive buttons and rivets, prior art techniques utilize conventional counters to keep track of the number of buttons and rivets manufactured each day. Such counters are generally cumbersome. Using button carrier 70, however, has two advantages. First, instead of counting the number of buttons and rivets manufactured each day, it is easier and simpler to count the number of carriers 70 each of which has a predetermined number of buttons and rivets thereon. The number of button carrier 70 is invariably less than the number of buttons and rivets produced each day. The second advantage is the ease in transporting and allocating buttons and rivets in the factory. Since each piece of garment requires a predetermined number of buttons and rivets, for example, one large button 14 and 10 small rivets 16, the correct type and number of buttons and rivets can be quickly allocated for each piece of garment. Instead of allocating and transporting the necessary number of buttons and rivets, it is simpler to transport and allocate a single button carrier 70 on which the necessary number and type of buttons and rivets are attached. The use of button carrier 70 eases the transportation and allocation of button and rivets steps in the manufacturing process.

It will be apparent to those skilled in the art that various modifications may be made within the spirit of the invention and the scope of the appended claims. For example, post 72 of button carrier 70 may be shortened considerably or eliminated altogether.

We claim:

1. A method of manufacturing a domed garment button for use with a garment, comprising providing a base member, said base member having a surface on which a radially extending groove is provided;

providing a front facing portion, said facing portion, configured in a generally domed convex configuration, including a periphery;

positioning said base member in a first die means, said first die means including an injection orifice;

aligning said radially extending groove of said base member with said first die means injection orifice;

positioning said front facing portion in a second die means;

mating said first die means with said second die means, whereby said front facing portion is positioned adjacent said base member; and injecting a material into said injection orifice such that said material travels through said base member groove and forms a backing member for maintaining said front facing portion in its generally domed configuration and forms a rim portion around said front facing portion periphery.

2. The method as claimed in claim 1, wherein said front facing portion is manufactured from a generally precious metallic material.

3. A method of manufacturing a crowned, domed garment button for use with a garment, comprising providing a generally cylindrical base member, said base member having a surface on which a radially extending groove is provided;

providing a generally disc-like front facing portion, said facing portion, configured in a generally domed convex configuration, including a periphery;

positioning said base member in a first die means, said first die means including an injection orifice;

aligning said radially extending groove of said base member with said first die means injection orifice;

positioning said front facing portion in a second die means;

mating said first die means with said second die means, whereby said front facing portion is positioned adjacent said base member; and injecting a material into said injection orifice such that said material travels through said base member groove and forms a backing member for maintaining said front facing portion in its generally domed configuration and forms a generally annular rim portion around said front facing portion periphery.

4. The method as claimed in claim 3, wherein said front facing portion includes a central, generally circular indentation and said second die means includes a central orifice, said method further comprises withdrawing air through said central orifice to align said front facing portion indentation with said second die means orifice, whereby said front facing portion is suctionably attached to said second die means.

5. The method as claimed in claim 3, wherein said front facing portion is manufactured from a generally precious metallic material.

6. A method of manufacturing a crowned, domed garment button for use with a garment, comprising providing a generally cylindrical base member, said base member having a surface on which a radially extending groove is provided;

providing a generally cylindrical attachment member, said attachment member being adapted to attach said garment button to said garment;

providing a generally disc-like front facing portion, said facing portion, configured in a generally domed convex configuration, including a periphery and a central, generally circular indentation;

positioning said base member in a first die means, said first die means including an injection orifice;

aligning said radially extending groove of said base member with said first die means injection orifice;

positioning said front facing portion in a second die means, said second die means including a central orifice that is adapted to withdraw air;

withdrawing air through said central orifice to align said front facing portion central indentation with said central orifice, whereby said front facing portion is suctionably attached to said second die means;

mating said first die means with said second die means, whereby said front facing portion is positioned adjacent said base member; and injecting a material into said injection orifice such that said material forms a generally annular rim portion that embeds said front facing portion periphery and travels through said radially extending groove and forms a backing member positioned between said facing portion and said base member for maintaining said front facing portion in its domed configuration.

7. The method as claimed in claim 6, wherein said front facing portion is manufactured from a generally precious metallic material.

8. The method as claimed in claim 6 or 7, wherein said rim portion and said backing member are manufactured from a generally thermoplastic material.

9. The method as claimed in claim 6 or 7, wherein said base member and said attachment member are manufactured from a generally metallic material.

10. A method of manufacturing a crowned, domed garment button for use with a garment, comprising providing a generally cylindrical base member, said base member including a surface on which a radially extending groove is provided and a generally circular groove for receiving a material therein;

providing a generally disc-like front facing portion, said facing portion, configured in a generally domed convex configuration including a periphery and a central, generally circular indentation;

positioning said base member in a first die means, said first die means including an injection orifice;

aligning said radially extending groove of said base member with said first die means injection orifice;

positioning said front facing portion in a second die means, said second die means including a central orifice that is adapted to withdraw air;

withdrawing air through said central orifice to align said front facing portion central indentation with said central orifice, whereby said front facing portion is suctionably attached to said second die means;

mating said first die means with said second die means, whereby said front facing portion is positioned adjacent said base member; and injecting a material into said injection orifice such that said material forms a generally annular rim portion that embeds said front facing portion periphery and travels through said radially extending groove and forms a backing member for maintaining said front facing portion in its domed configuration.

11. The method as claimed in claim 10, wherein said front facing portion is manufactured from a generally precious metallic material.

12. The method as claimed in claim 10 or 11, wherein said rim portion and said material received within said base member groove are manufactured from a generally thermoplastic material.

13. The method as claimed in claim 10 or 11, wherein said base member is manufactured from a generally metallic material.

* * * * *